US007275318B2

(12) United States Patent
Chu et al.

(10) Patent No.: US 7,275,318 B2
(45) Date of Patent: Oct. 2, 2007

(54) FIXTURE FOR INSTALLING OR REMOVING COIL SPRINGS

(75) Inventors: Jung-Jang Chu, Tu-chen (TW); Hsiu-Yuan Hsu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 398 days.

(21) Appl. No.: 10/867,966

(22) Filed: Jun. 14, 2004

(65) Prior Publication Data

US 2004/0250401 A1 Dec. 16, 2004

(30) Foreign Application Priority Data

Jun. 11, 2003 (TW) ..... 92115900 A

(51) Int. Cl.
*H01R 43/20* (2006.01)

(52) U.S. Cl. ..... 29/876; 29/227; 29/235; 29/270; 29/278; 29/426.6; 29/451; 29/750; 29/751; 29/752; 29/753; 29/754; 81/177.2; 81/177.85; 140/89

(58) Field of Classification Search ..... 29/876, 29/227, 235, 270, 426.6, 451, 278, 750–754; 81/177.2, 177.85; 140/89; 254/10.5; 267/177
See application file for complete search history.

(56) References Cited

U.S. PATENT DOCUMENTS 4,872,645 A * 10/1989 Dossier ..... 254/10.5
5,954,314 A * 9/1999 Weisshaar ..... 254/10.5

* cited by examiner

*Primary Examiner*—A. Dexter Tugbang
*Assistant Examiner*—Tim Phan
(74) *Attorney, Agent, or Firm*—Wei Te Chung

(57) ABSTRACT

A spring fixture (1) is provided for quickly installing or uninstalling a coil spring (36) in or from an electrical connector (3). The fixture includes an operation member (11) having a generally cylindrical handle (12) at an end thereof and an action member (16) assembled on an opposite end of the operation member by a screw cap (18). The action member defines a recess (1620) thereby forming a semi-circular bottom wall (1622) and a semi-circular inner wall (1624). During installing or removing the spring, the spring is received in the recess and surrounded by the inner wall. A method of using the fixture to install and remove the spring is also provided.

2 Claims, 7 Drawing Sheets

FIXTURE FOR INSTALLING OR REMOVING COIL SPRINGS

CROSS REFERENCE TO RELATED DOCUMENT

This application claims priority to TAIWAN Patent Applications No. 92115900, filed on Jun. 6, 2003.

BACKGROUND OF THE INVENTION

1. Field of the Invention

The present invention is related to fixtures used for installing or removing coil springs, and particularly to a fixture used for installing or uninstalling a coil spring into or from an electrical connector. The present invention is also related to a method of using the fixture to install and remove the coil spring.

2. Description of the Prior Art

Electrical connectors are widely used for electrically connecting electronic packages such as integrated circuits (ICs) with substrate circuits such as burn-in boards. Referring to FIGS. 6 and 7, a typical electrical connector 3' comprises an insulative housing 30' to be mounted on a burn-in board (not shown), a number of electrical contacts (not shown) received in the housing 30' and electrically connecting with the burn-in board, a pair of actuation members 34' assembled on two opposite sides of the housing 30', and a lid 32' assembled on the actuation members 34' and capable of moving relative to the housing 30'. The housing 30' defines four first step holes 300' in four corners thereof. The lid 32' defines four second step holes 320' in four corners thereof, the second step holes 320' corresponding to the first step holes 300'. Four coil springs 36' are assembled between the housing 30' and lid 32', with ends of the springs 36' engaging in the first and second step holes 300', 320', respectively. When the lid 32' is pressed down to drive the actuation members 34', an IC (not shown) can be attached on the connector 3' with Low Insertion Force. When the lid 32' is released, the springs 36' rebound to drive the lid 32' up automatically and the IC can be securely received in the connector 3'.

During assembly of the connector 3', the actuation members 34' are assembled on the housing 30'. The lid 32' is assembled on the actuation members 34'. A vertical height between a bottom surface of the lid and a top surface of the housing is defined, signed with B in FIG. 7A. The springs 36' are assembled between the lid 32' and the housing 30'. Because a vertical height between the housing 30' and the lid 32' is smaller than a length of each of the springs, it is difficult to install or uninstall the springs 36' into or from the connector 3' by hand. Therefore, a fixture is generally needed.

A typical fixture 1' comprises a generally cylindrical handle 12', a J-shaped pin 14' coaxially extending from an end of the handle 12', and a lever 16' assembled perpendicularly on an opposite end of the handle 12' via a screw 18'. The pin 14' forms a hook 140' at a free end thereof, the hook 140' having a length marked with A in FIG. 7A. The lever 16' forms a wedge 160' at a free end thereof, the wedge 160' extending perpendicularly from the lever 16'.

A method of installing one of the springs 36' into the connector 3' by the fixture 1' generally comprises the following steps:

A. Inserting the hook 140' of the fixture 1' into a bottom end of the spring 36';

B. Putting an opposite top end of the spring 36' into one of the second step holes 320' of the lid 32';

C. Lifting up the fixture 1' to compress the spring 36';

D. Moving the bottom end of the spring 36' near the first step hole 300' of the housing 30';

E. Withdrawing the hook 140' from the spring 36' to make the spring 36' abut against a surface of the housing 30' near the first step hole 300'; and F. Pushing the bottom end of the spring 36' into the first step hole 300' thereby securely installing the spring 36' into the connector 3'.

In above-mentioned operation, it is difficult to withdraw the hook 140' from the spring 36' in step D because the hook 140' is inserted into the bottom end of the spring 36'. When the fixture 1' is forcedly withdrawn, the spring 36' is liable to be detached away from the connector 3' with the fixture 1' such that the operation fails. Additionally, the more longer the spring is, the more difficultly the top end of the spring 36' is put into the second step hole 320' of the lid 32' in step B, because of the hook 140' inserted into the bottom end of the spring 36'.

On the other hand, increasing the height A of the hook 140' is benefit to securely attach the spring 36' to the hook 140'. When the height A of the hook 140' is higher than the vertical height B between the lid 32' and the housing 30', the fixture 1' may be unlikely inserted into a space between the lid 32' and the housing 30' thus installing the spring 36' is not completed. When the height A of the hook 140' is short, the spring 36' is liable to escape from the hook 140' thus the assembly operation can not go on.

A method of uninstalling one of the springs 36' from the connector 3' generally comprises the following steps:

A. Inserting the wedge 160' into a space between two adjacent coils of the spring 36';

B. Lifting up the fixture 1' to compress the spring 36' until the bottom end of the spring 36' is exposed out of the first step hole 300' of the housing 30'; and C. Withdrawing the fixture 1' from the connector 3' thereby uninstalling the spring 36' from the connector 3'.

However, the spring 36' is apt to escape from the wedge 160' of the fixture 1' thus the operation can be blocked.

In view of the above, a new fixture that overcomes the above-mentioned disadvantages is desired.

SUMMARY OF THE INVENTION

An object of the present invention is to provide a coil spring fixture which is configured to quickly reliably install and remove a coil spring.

Another object of the present invention is to provide a method of using a coil spring fixture to reliably install or uninstall a coil spring into or from an electrical connector.

To fulfill the above objects, a coil spring fixture in accordance with a preferred embodiment of the present invention is provided. The fixture is used for installing or uninstalling a coil spring into or from an electrical connector. The fixture comprises an operation member and an action member formed at an end of the operation member. The operation has a handle at an opposite end thereof, the handle having a generally cylindrical profile. The action member defines a generally semi-circular recess, thereby forming a generally semi-circular bottom wall, and a generally semi-circular inner wall.

A method of using the fixture to install an coil spring in an electrical connector comprises the following step:

A. Assembling the spring on the fixture with the bottom wall thereof inserted into a space between two adjacent coils of the spring and the inner wall surrounding the spring;
B. Putting the top end of the spring into the second step hole of the lid;
C. Lifting up the fixture to compress the spring;
D. Moving the bottom end of the spring above the first step hole of the housing;
E. Releasing the spring to put the bottom end of the spring into the first step hole; and
F. Withdrawing the fixture from the connector.

A method of using the fixture to uninstall the spring from the connector comprises the following steps:

A. Inserting the bottom wall of the fixture into a space between two adjacent turns of the spring;
B. Lifting up the fixture to compress the spring until the bottom end of the spring is exposed from the first step hole of the housing; and
C. Moving the fixture away from the connector thereby uninstalling the spring from the connector.

Other objects, feature novels and advantages of the invention will become more apparent from the following detailed description when taken in conjunction with the accompanying drawings, in which:

DETAILED DESCRIPTION OF THE PREFERRED EMBODIMENT OF THE INVENTION

Reference will now be made to the drawings to describe the invention in detail.

Figure 1:
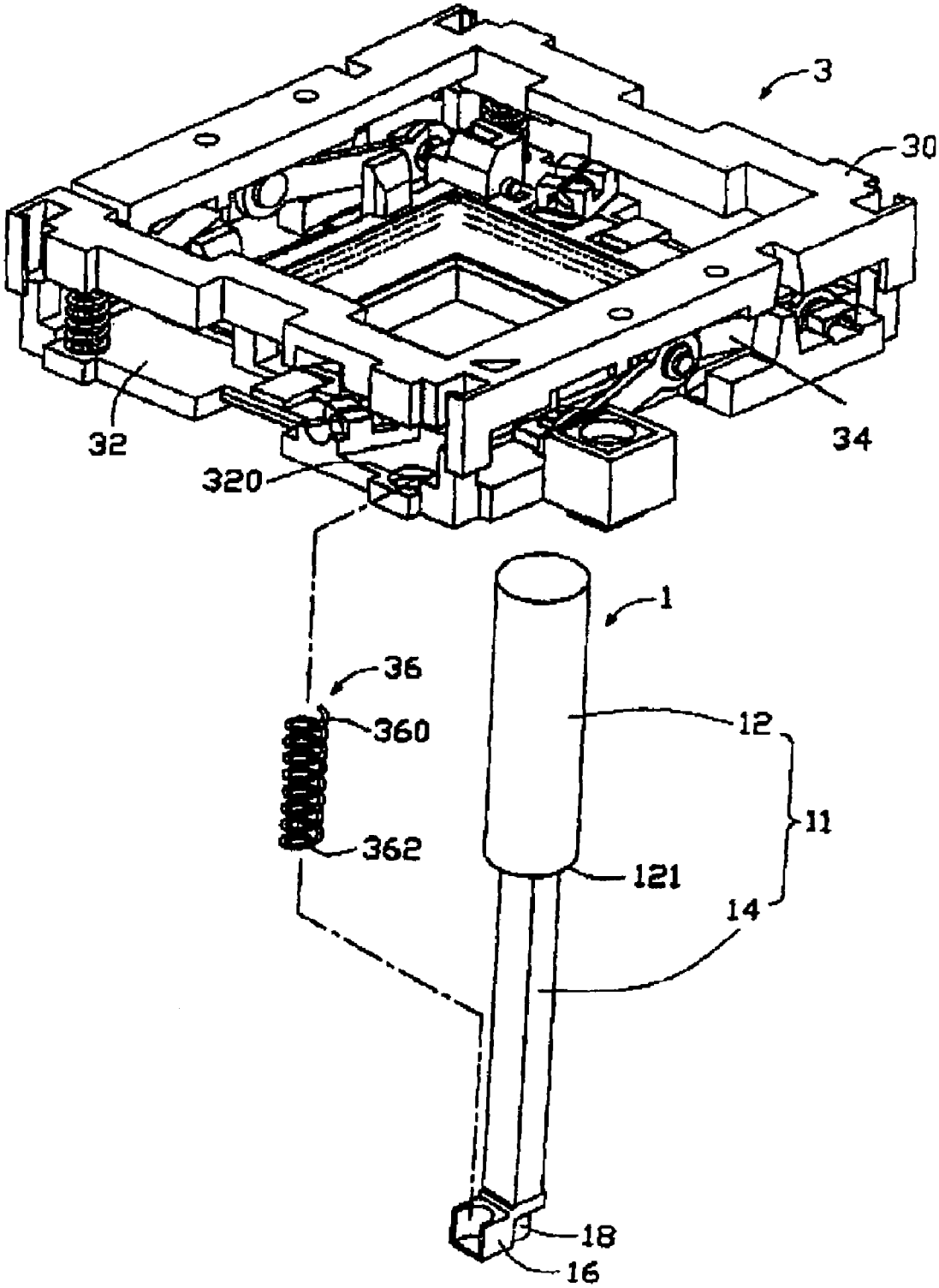
FIG. 1 is a perspective view of a fixture and a connector to which the fixture assembles a spring, according to an embodiment of the invention.
Figure 3A:
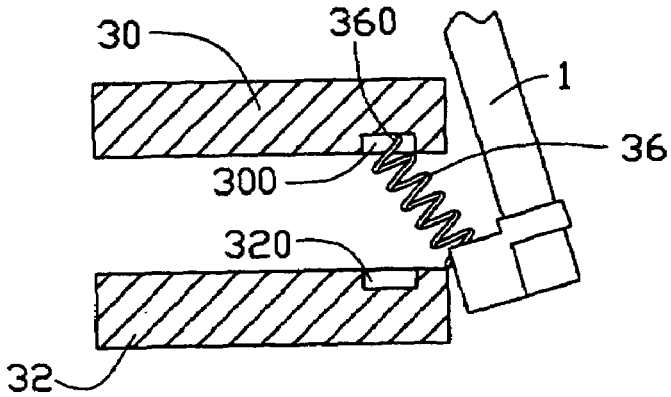
FIG. 3A-3C show a method of installing the spring to the connector by the fixture of FIG. 1.

Referring to FIGS. 1 and 3A, a fixture 1 in accordance with the preferred embodiment of the present invention is provided for installing or removing a coil spring onto or from an electrical connector 3. The connector 3 is used for electrically connecting an IC (not shown) with a burn-in board (not shown). The connector 3 comprises an insulative housing 32 mounted on the burn-in board, a number of electrical contacts (not shown) received in the housing 32 and electrically connect with the burn-in board, a pair of actuation members 34 assembled on two opposite sides of the housing 32, and a lid 30 assembled on the actuation members 34 and capable of moving up and down relative to the housing 32. The housing 32 defines four first step holes 320 at four corners thereof respectively. The lid 30 defines four second step holes 300 at four corners thereof respectively, the second holes 300 corresponding to the first holes 320. Four coil springs 36 are assembled between the housing 32 and the lid 30, with top and bottom ends 360, 362 of the springs 36 received in the first and second step holes 300, 320 respectively. When the lid 30 is pressed down with the springs 36 compressed to drive the actuation members 34, an IC (not shown) can be attached to the connector 3 with Low Insertion Force. When the lid 30 is released, the springs 36 rebound to drive the lid 30 up automatically. The IC can be securely received in the connector 3 and electrically connects with the contacts. Therefore, the connector 3 electrically connects the IC with the burn-in board.

Figure 2:
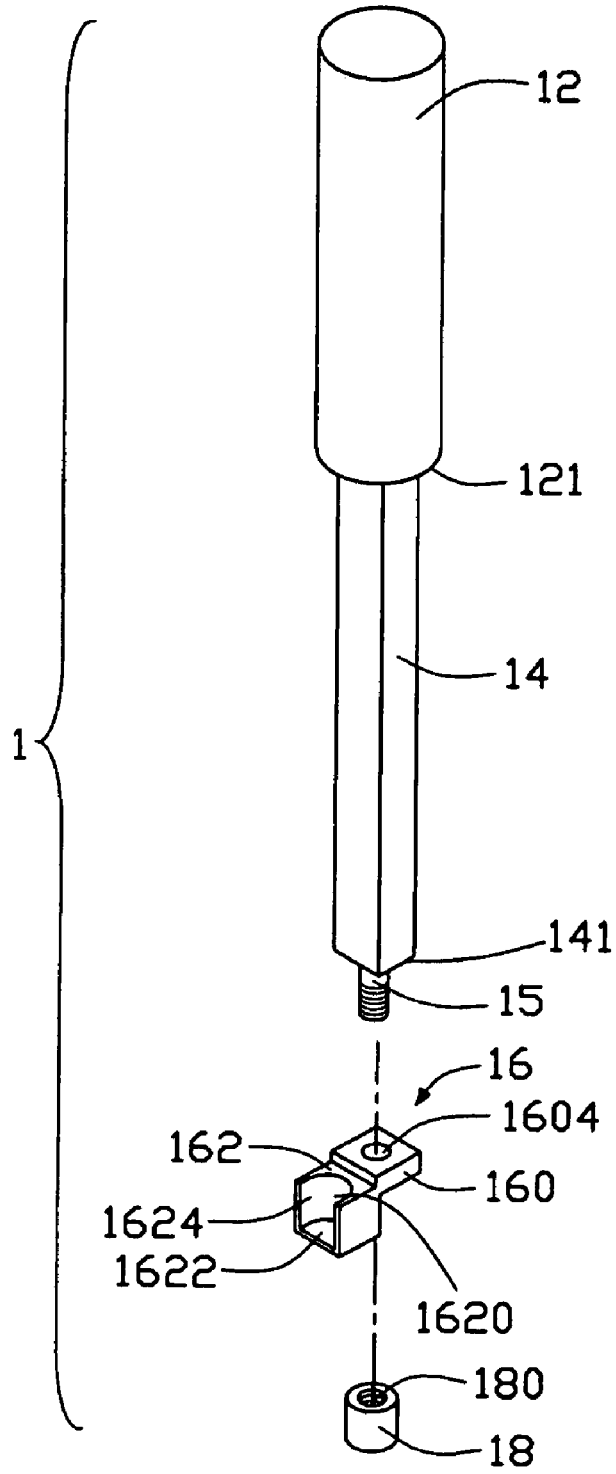
FIG. 2 is an exploded perspective view of the fixture of FIG. 1.

Referring to FIG 2. the fixture 1 has an operation member 11, an L-shaped action member 16 assembled on an end of the operation member 11, and a screw cap 18. The operation member ii has a handle 12 with a circular profile, a lever 14 with a rectangular profile and a pin 15. The lever 14 extends coaxially from an end 121 of the handle 12. The pin 15 extends coaxially from an end 141 of the lever 14. The pin 15 is opposite to the handle 12 and has an external thread thereat.

The action member 16 has a generally cubic body portion 162 and a mounting portion 160. The body portion 162 defines a generally semi-circular recess 1620, thereby forming a generally semi-circular bottom wall 1622, and a generally semi-circular inner wall 1624. The mounting portion 160 extends perpendicular from a top end of a sidewall of the body portion 162. The mounting portion 160 defines a hole 1604 in a middle portion thereof, a diameter of the holes 1604 larger than a diameter of the pin 15 of the operation member 11. The screw cap 18 is a generally cylindrical configuration, defining a screw hole 180 in a middle portion thereof. In assembly, the pin 15 of the operation member 11 inserts through the hole 1604 of the mounting portion 160 of the action member 16, and engages in the screw hole 180 of the screw cap 18. In this preferred embodiment, a diameter of the semi-circular bottom wall 1622 of the fixture 1 is generally equal to a diameter of the spring 36. It is understood that the action member 16 can be replaced by a different coil spring 36.

Figure 3B:
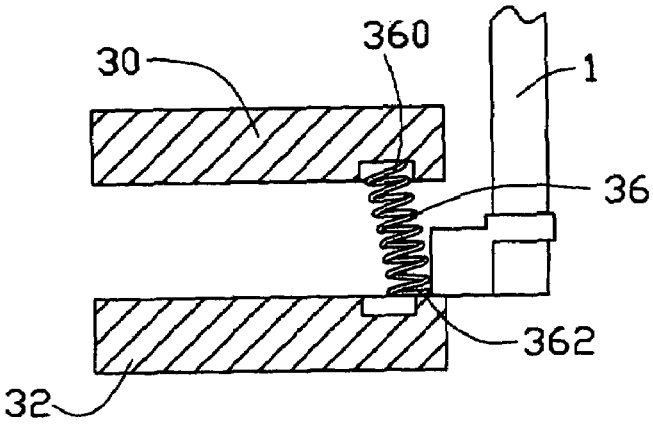
Figure 3C:
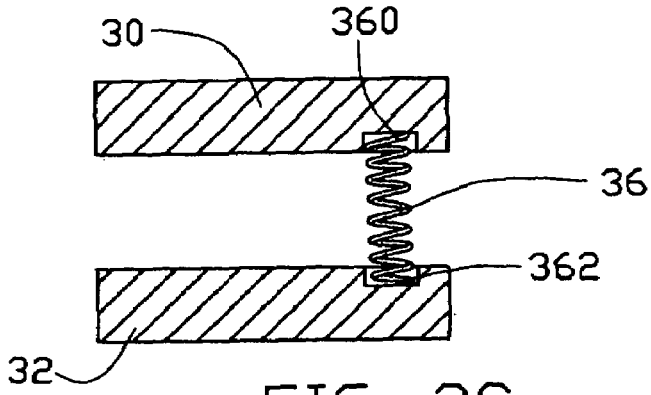

Referring to FIGS. 3A to 3C, a method of installing the spring in the connector comprises the following steps:

A. Putting the spring on the bottom wall 1622 of the fixture 1, with the bottom end 362 of the spring in the recess 120 and the inner wall 1624 surrounding the spring 36;
B. Slanting the fixture 1 and putting the top end 360 of the spring 36 into one corresponding second step hole 300 of the lid 30;
C. Lifting up the fixture to 1 compress the spring 36;
D. Moving the bottom end 362 of the spring 36 toward the first step hole 320;
E. Withdrawing the fixture 1 to make the bottom end 362 of the spring 36 abut against a top surface of the housing 32; and
F. Pushing the bottom end 362 of the spring 36 into the first step hole 320 thereby securely installing the spring 36 in the connector 3.

Figure 4A:
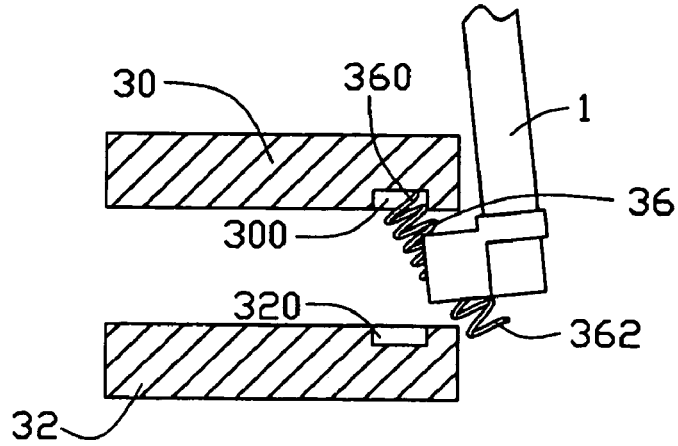
FIG. 4A-4C show another method of installing the longer spring to the connector by the fixture of FIG. 1.
Figure 4B:
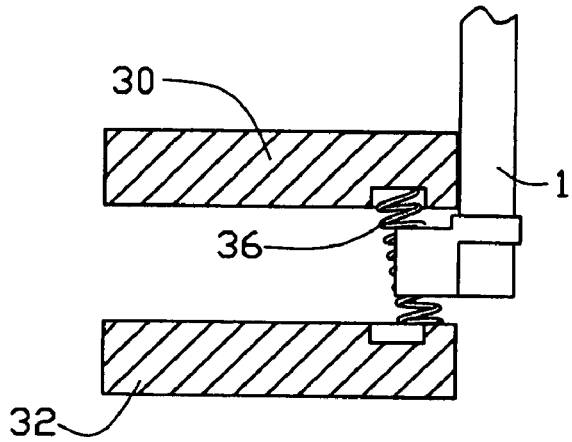
Figure 4C:
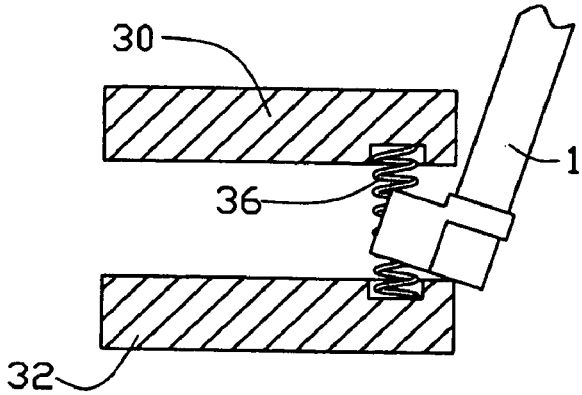

Referring to FIGS. 4A to 4C, the spring 36 is too long to be assembled on the connector 3 by the above-mentioned method, since an alternative method of installing the spring

36 in the connector 3 is provided. The alternative method comprises the following steps:

G. Assembling the spring 36 on the fixture 1 with the bottom wall 1622 thereof inserting into a space between two adjacent turns of the spring 36 and the inner wall 1624 surrounding the spring 36;

H. Putting the top end 360 of the spring 36 into the second step hole 300 of the lid 30;

I. Lifting up the fixture 1 to compress the spring 36 and moving the bottom end 362 of the spring 36 above the first step hole 320 of the housing 32;

J. Releasing the spring 36 and putting the bottom end 362 of the spring 36 into the first step hole 320; and K. Removing the fixture 1 from the connector 3.

Figure 5A:
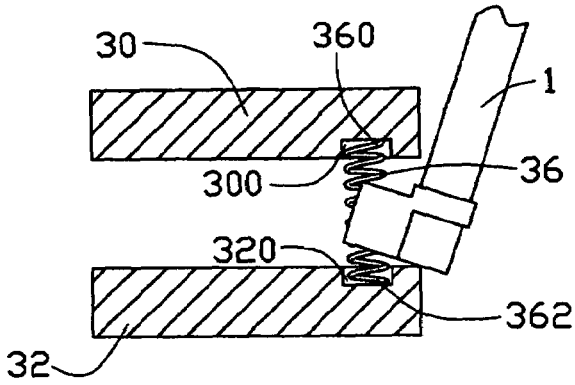
FIG. 5A-5C show a method of uninstalling the spring from connector by the fixture of FIG. 1.
Figure 5B:
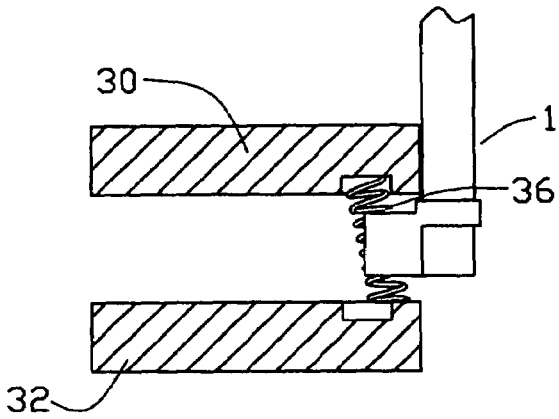
Figure 5C:
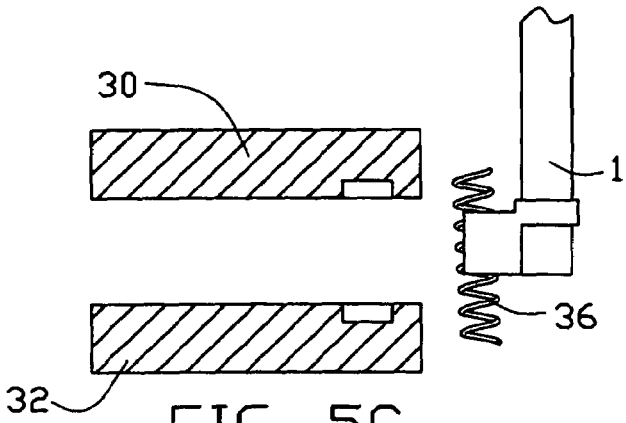
Figure 6:
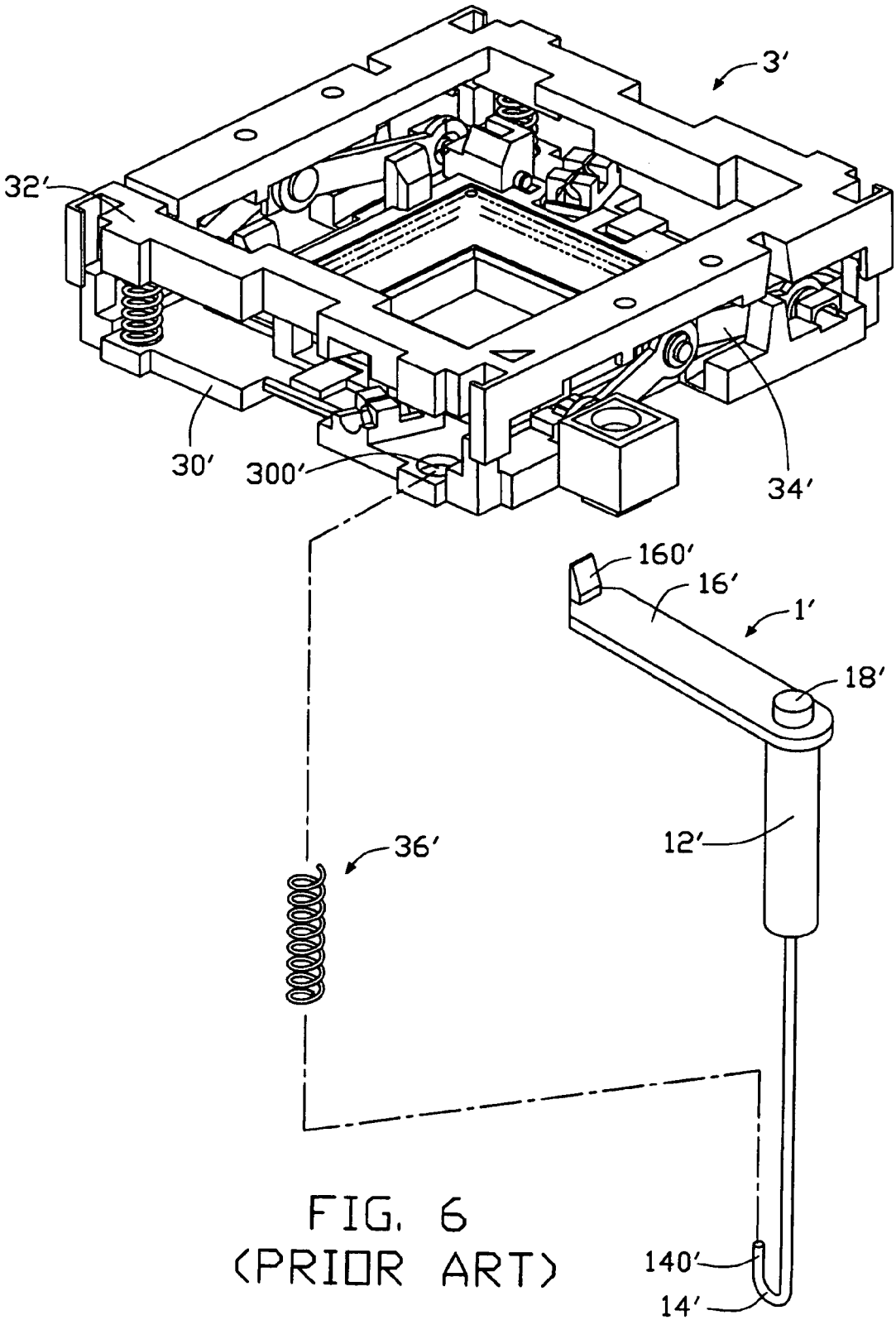
FIG. 6 (PRIOR ART)
FIG 6 is a perspective view of the conventional fixture and the corresponding connector.
Figure 7A:
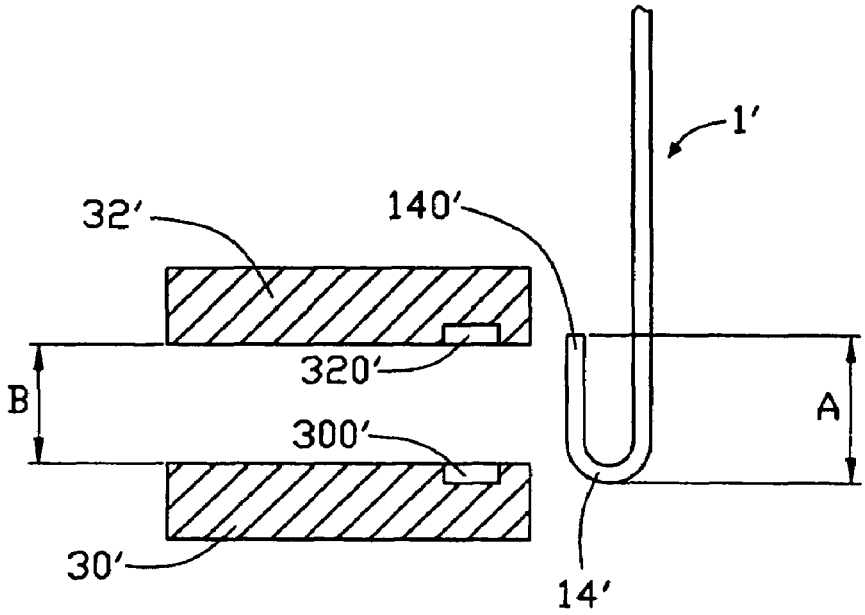
FIG. 7A (PRIOR ART)
FIG. 7A shows a longer hook of the fixture of FIG. 6 with regard to agap between the lid and the housing.
Figure 7B:
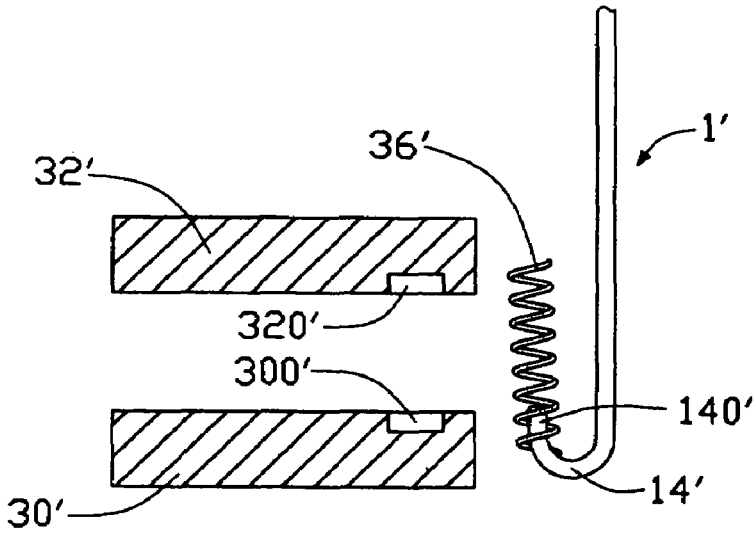
FIG. 7B (PRIOR ART)
FIG. 7B shows a shorter hook of the fixture of FIG. 6 with regard to the gap between the lid and the housing and the corresponding spring.

Referring to FIGS. 5A to 5C, a method of uninstalling the spring 36 from the connector 3 comprises the following steps:

D. Inserting the bottom wall 1622 of the fixture 1 into a space between two adjacent turns of the spring 36;

E. Lifting up the fixture 1 to compress the spring 36 until the bottom end 362 of the spring 36 exposing from the first step hole 320 of the housing 32; and F. Moving the fixture 1 away from the connector 3 thereby uninstalling the spring 36 from the connector 3.

In the above operations, the bottom wall 1622 and the inner wall 1624 of the fixture 1 holds the spring 36 and the spring 36 is unlikely to break out from the fixture 1 during installing the spring 36. Additionally, the bottom wall is easily withdrawn the bottom end 362 of the spring 36 and the spring 36 is reliably installed in the connector 3.

From the foregoing it will be recognized that the principles of the invention may be employed in various arrangements to obtain the features, advantages and benefits described above. It is to be understood, therefore, that even though numerous characteristics and advantages of the invention have been set forth together with details of the structure and function of the invention, this disclosure is to be considered illustrative only. Various changes and modifications may be made in detail, especially in matters of size, shape and arrangements of parts, without departing from the spirit and scope of the invention as defined by the appended claims.

What is claimed is:

1. A spring fixture used for installing or removing a coil spring onto or from an electrical connector, comprising an operation member having a handle at an end thereof to facilitate operating the fixture and an action member formed at an opposite end of the operation member, the action member defining a recess and forming a bottom wall under the recess and an inner wall, during installing or removing the spring, the spring received in the recess partly and surrounded by the inner wall;

wherein the operation member forms a pin extending coaxially therefrom and havine an external thread thereat, the pin inserting through a hole of the action member and engaging in a screw cap thereby assembling the action member on the operation member with a bottom surface of the screw cap located in a same plane with or higher than the bottom wall of the action member.

2. The spring fixture as claimed in claim 1, wherein the action member comprises a body portion defining the recess therein and a mounting portion, and the hole defined in a middle portion of the mounting portion.

* * * * *